US006157282A

United States Patent [19]

Hopkinson

[11] Patent Number: 6,157,282

[45] Date of Patent: Dec. 5, 2000

[54] TRANSFORMER COOLING METHOD AND APPARATUS THEREFOR

[75] Inventor: Philip J. Hopkinson, Charlotte, N.C.

[73] Assignee: Square D Company, Palatine, Ill.

[21] Appl. No.: 09/222,623

[22] Filed: Dec. 29, 1998

[51] Int. Cl.[7] ..... H01F 27/10; H01F 27/08

[52] U.S. Cl. ..... 336/57; 336/60; 336/58

[58] Field of Search ..... 336/60, 55, 61, 336/205, 57, 58

[56] References Cited

U.S. PATENT DOCUMENTS

| | | | |
|---|---|---|---|
| 3,201,728 | 8/1965 | McWhirter | 336/60 |
| 4,039,990 | 8/1977 | Philp | 336/60 |
| 4,145,679 | 3/1979 | Mitchell, Jr. | 336/57 |
| 4,491,817 | 1/1985 | Koyama | 336/55 |

OTHER PUBLICATIONS

Exhibit A—France Transfo Transformer With Heat Exchanger.

Exhibit B—General Electric Transformer With Heat Exchanger.

*Primary Examiner*—Michael L. Gellner

*Assistant Examiner*—Anh Mai

*Attorney, Agent, or Firm*—Michael J. Femal; Larry I. Golden

[57] ABSTRACT

This invention relates to a cooling system for a transformer. A winding defining a coil, including a duct having an open top and bottom, is sealed to a sleeve, thus forming a closed circulatory path. A fluid is retained and circulated within the circulatory path.

30 Claims, 6 Drawing Sheets

TRANSFORMER COOLING METHOD AND APPARATUS THEREFOR

DESCRIPTION

1. Technical Field

The present invention relates generally to transformers, and more particularly to a system for cooling transformers.

2. Background of the Invention

Transformers are used to transfer electric power between circuits that operate at different voltages. A simple model of a transformer consists of two insulated electrical windings, a primary and a secondary, coupled by a common magnetic circuit. When an alternating voltage is applied to the primary winding, an alternating current will flow to a load connected to the secondary winding.

Transformers must be designed to withstand the adverse effects resulting from high voltage and temperature. The electrical insulation of the windings is of great importance. Not only must the conductor turns be insulated from each other, but there must be adequate insulation strength between windings and from each winding to ground. The insulation must withstand not only the normal service voltage, but also overvoltages that may occur in service due to lightning strikes and switching operations.

Transformers operate near an efficiency of 98–99%. Any losses generally arise from hysteresis and eddy current loss in the core, resistive loss in the windings, and circulating current loss in structural parts due to the proximity of heavy current leads. Although the total loss may be only 1% of the power transmitted, this may be equivalent to 10 MW on a large transformer. Careful design is required to avoid overheating of the windings which would cause premature aging of the insulation and lead to an electric breakdown in the windings. The choice of insulating materials and the electrode spacing controlled by those materials will greatly determine the quality of the transformer.

The windings are made from low resistive materials. The cross-sectional area of the conductor must be sufficient to reduce losses caused by resistive heating of the windings when carrying load current. The allowable current density is dependent upon the cooling system used.

Transformers, including those comprising hybrid epoxy cast resin, are usually quite large and generate great amounts of heat. Traditional methods of cooling transformers include air cooling or immersing the transformer in oil. Air cooled transformers are large because of the greater spacing requirements needed for proper operation, due to the relatively low dielectric strength of air as compared to other materials. In addition, the difference between the dielectric strength of the insulating material of the coil as compared to the air within the duct of an air-cooled system, creates a dielectric stress at the coil-duct interface that can erode the coil and limit the life of the transformer.

Transformers cooled by oil immersion pose a risk to the environment through possible contamination resulting from spills occurring during maintenance, repair or damage to the transformer or its oil tank.

SUMMARY OF THE INVENTION

Generally stated, this invention sets forth a method and an apparatus for cooling transformers. According to one aspect of the invention, the method requires forming a coil winding with at least one generally longitudinal duct through the coil with an opening on the top and bottom of the coil. A sleeve is provided having an upper manifold and a lower manifold.

The upper and lower manifolds of the sleeve are sealed to the top and bottom of the coil, forming a closed circulatory path. Retained within the closed circulatory path is a fluid.

According to further aspect of the invention, the method requires forming a primary winding and a secondary winding into a coil. The coil includes at least one duct, generally longitudinal, having an opening at the top and bottom. A sleeve is provided having an upper manifold and a lower manifold. Sealing the upper manifold to the top of the coil and the lower manifold to the bottom of the coil forms a closed circulatory path. A fluid is retained within the closed circulatory path.

According to yet another aspect of the invention, the coil is comprised of a primary winding and a secondary winding. The coil's primary and secondary windings define at least one duct, generally longitudinal, having an opening on the coil's top and bottom. A sleeve having an upper manifold and a lower manifold is respectively sealed to the top and bottom of the coil, thus defining a closed circulatory path. A fluid is retained within the closed circulatory path.

The fluid retained within the closed circulatory path is sufficient to adequately cool the transformer while at the same time lessening the probability of contaminating the environment due to a mishap because the fluid is retained within a closed system. Additionally, since the dielectric strength of the fluid is greater than that of air, the size of the transformer can be significantly reduced due to the decreased amount of space required to adequately insulate the coil windings and ensure satisfactory operation. Moreover, the dielectric strength of the fluid can be matched with the dielectric strength of the coil's insulator, i.e., epoxy, to prevent and/or minimize the adverse effects of dielectric stress discontinuities present at the coil-duct interface.

Also contemplated by this invention is the implementation of a heat exchanger within the closed circulatory path.

It is also contemplated that this invention can be incorporated for use with transformers wherein part of the winding is common to both the primary and secondary circuits, i.e., autotransformers.

Other advantages and aspects of the present invention will become apparent upon reading the following description of the drawings and detailed description of the invention.

DETAILED DESCRIPTION

Figure 1:
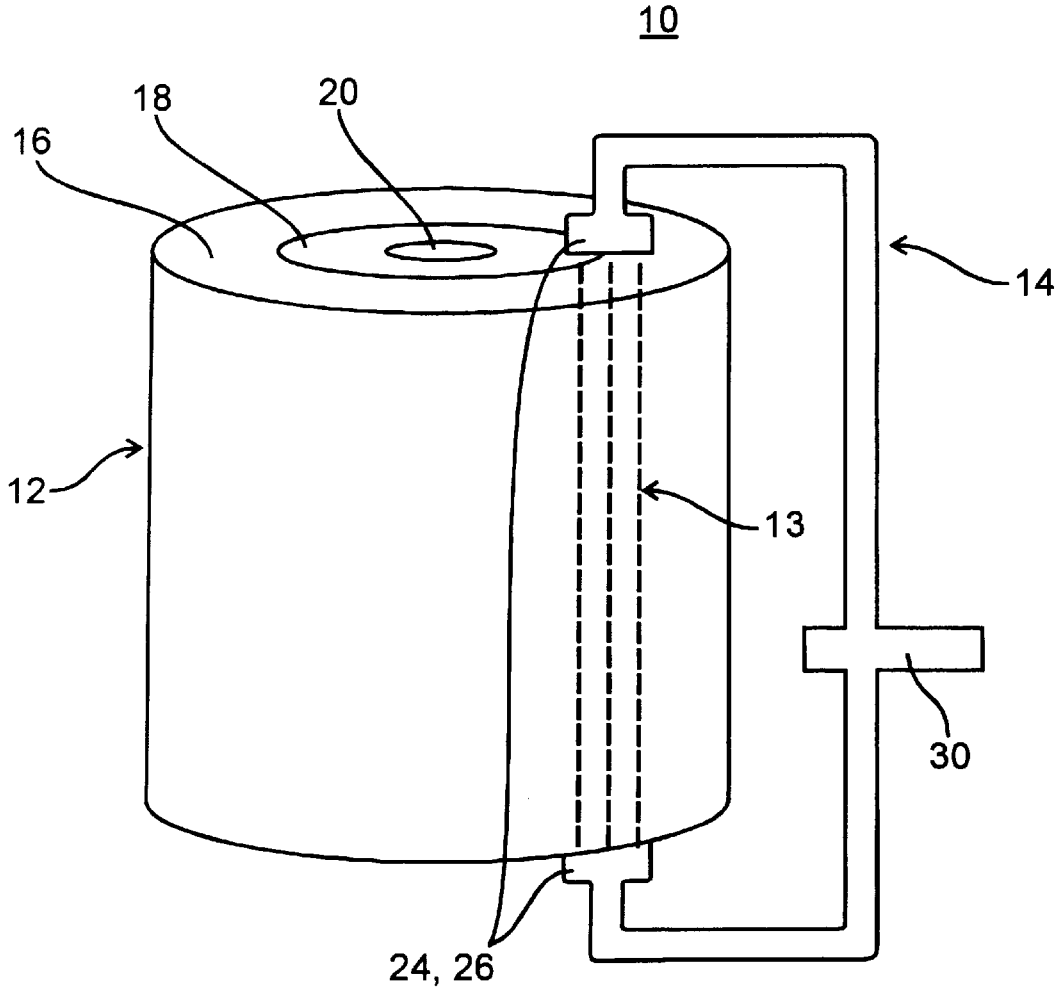
FIG. 1 is a perspective view of the cooling system of the present invention with the ducts shown in phantom.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

FIGS. 1–6 disclose a cooling system 10 for a transformer 12 in accordance with the principles of the present invention. Initially, the structure of the cooling system 10 will be described in detail, followed by a further description of its operation.

As disclosed in FIG. 1, the cooling system 10 generally includes a coil 12 having a duct 13, and a sleeve 14. The sleeve 14 is attached to the coil 12, creating a closed circulatory path comprising the duct 13 within the coil 12 and the attached sleeve 14.

Figure 2:
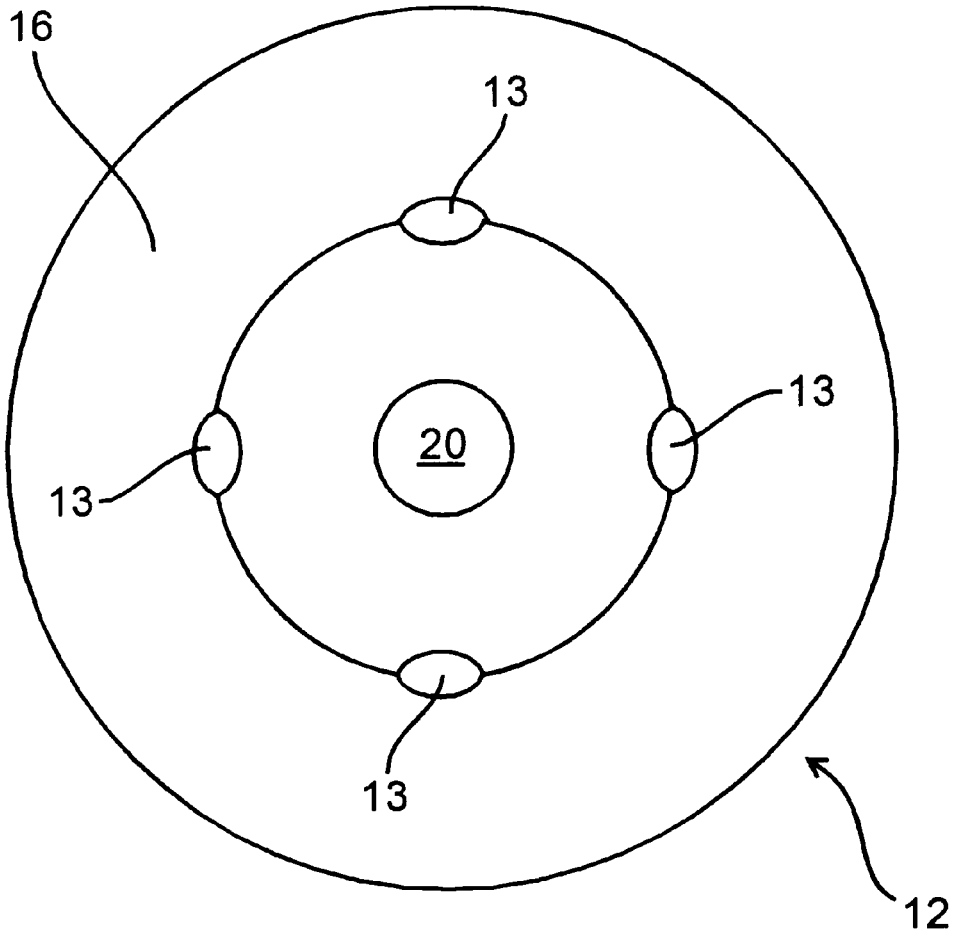
FIG. 2 is a cross-sectional top view of the cooling system of FIG. 1.
Figure 3:
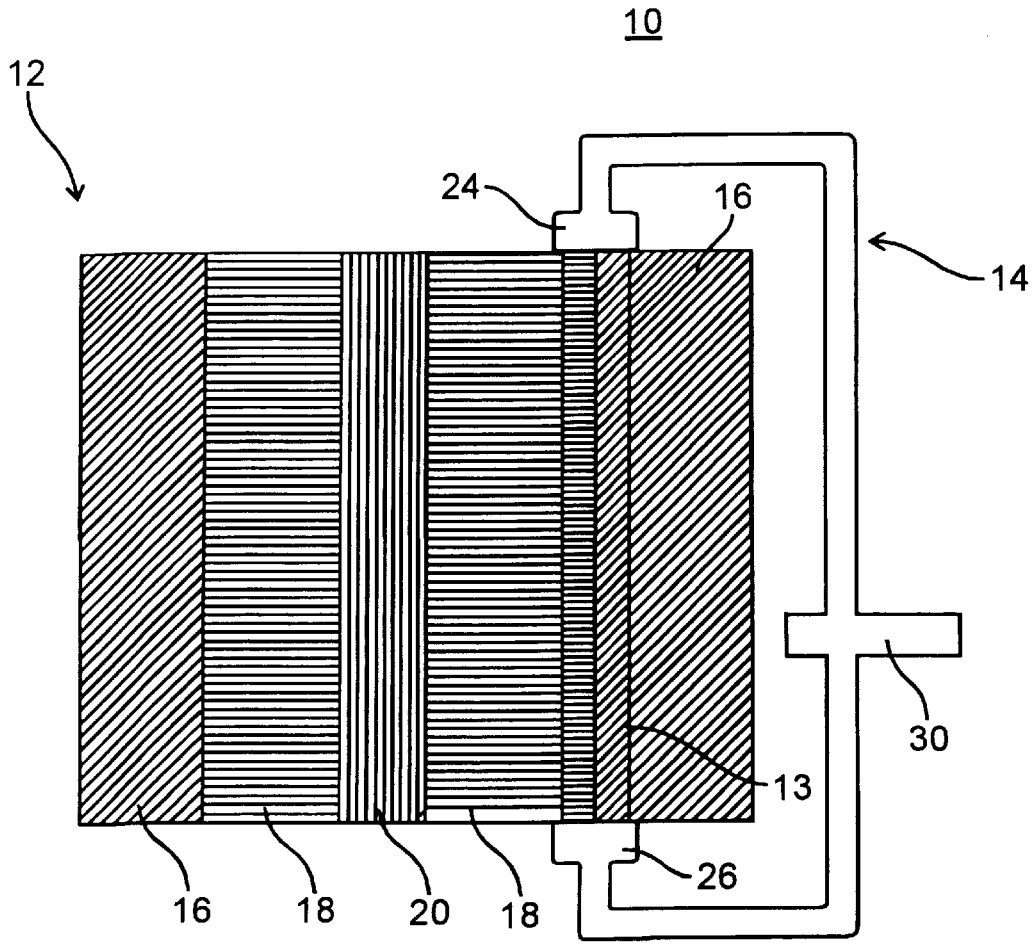
FIG. 3 is a cross-sectional front view of the cooling system of FIG. 1.
Figure 4:
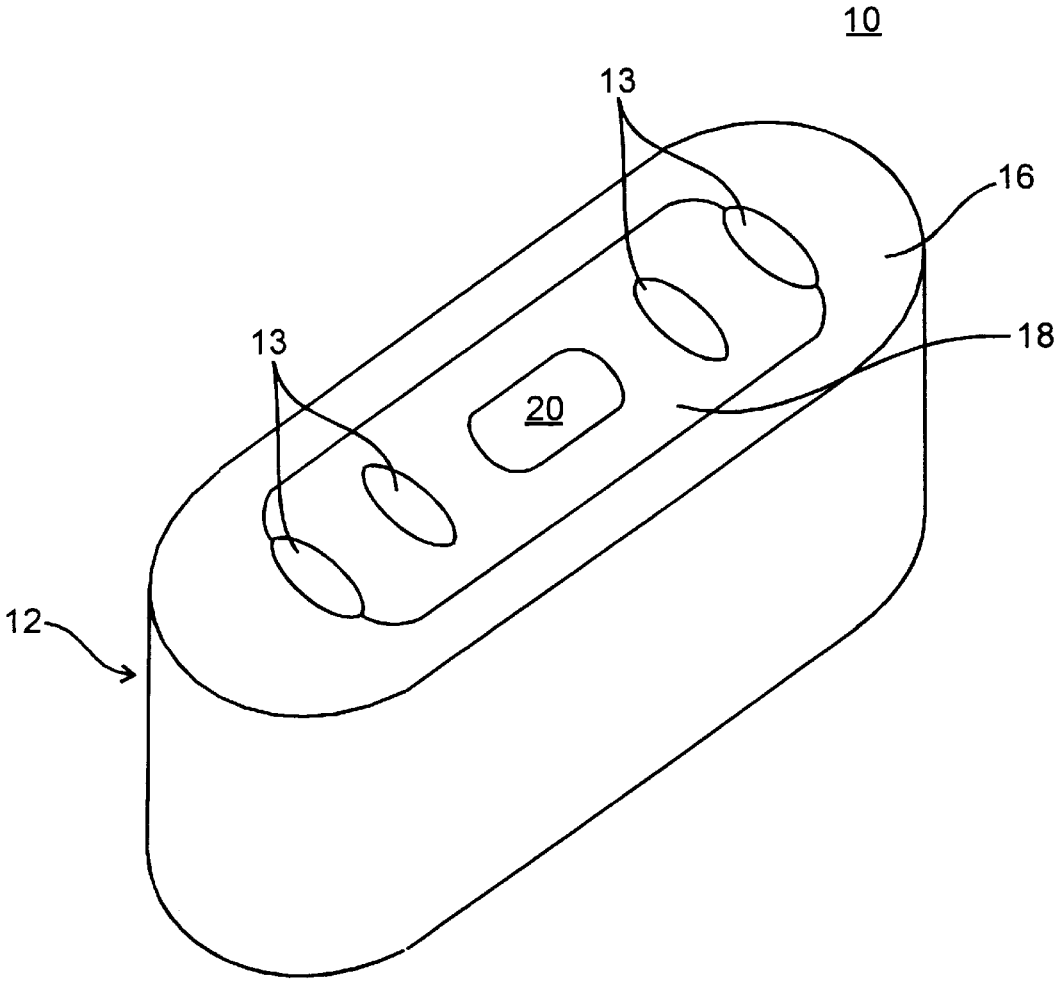
FIG. 4 is a perspective view of the cooling system for a transformer with multiple ducts.
Figure 5:
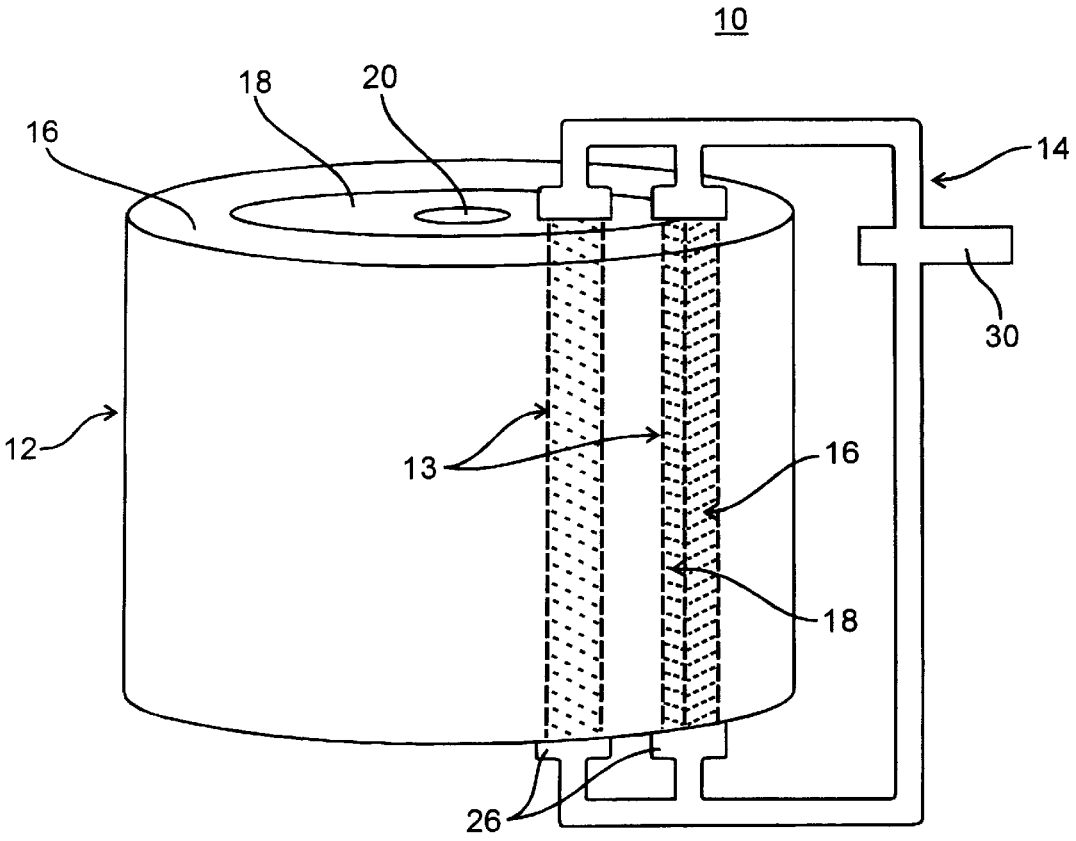
FIG. 5 is a perspective view of the cooling system incorporating multiple ducts, wherein the ducts are shown in phantom.
Figure 6:
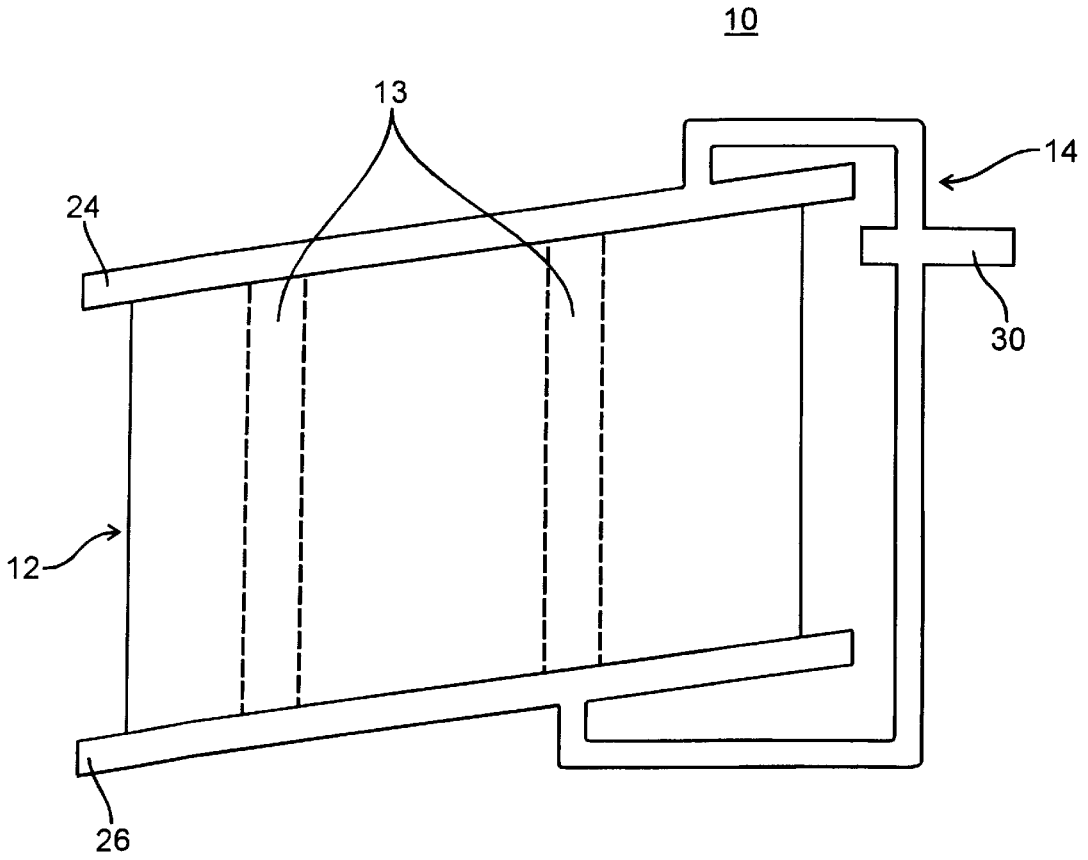
FIG. 6 is a perspective view of the cooling system with an alternative embodiment of the manifolds attached to the top and bottom of the coil transformer, wherein the ducts are shown in phantom.

The coil 12 includes two sets of windings, generally denoted as a primary winding 16 and a secondary winding 18, about a core 20. The duct 13 extends longitudinally within the coil 12 from its top to its bottom. While the duct 13 may be located entirely within the primary 16 or secondary 18 winding, the duct 13 is preferably located between the primary 16 and secondary 18 windings, as shown in FIGS. 2 and 3. Multiple ducts 13 within and between adjacent windings are contemplated for transformers requiring additional cooling needs, as shown in FIGS. 4 and 5.

The sleeve 14 has two manifolds 24, 26, one at each end of the sleeve 14. One manifold 24 is sealed to the top of the coil 12 and the other manifold 26 is sealed to the bottom of the coil 12. Attaching the sleeve 14 to the coil 12 creates a closed circulatory path. Incorporated into the sleeve 14 is a cooling apparatus 30, preferably a heat exchanger. As the fluid (not shown) circulates within the closed circulatory path, its thermal properties facilitate the cooling of the transformer.

Although a variety of materials may be used within the circulatory path, it is preferable to use a liquid such as an oil, silicone or mineral oil having a high flashpoint, e.g., RTEMP. These liquids allow for the transformer to be smaller in size because the thermal capacity/efficiency of the oil/silicone/mineral oil is superior to air and thus the distances between the windings can be lessened without adversely affecting the electromagnetic characteristics of the transformer.

Using a liquid whose dielectric strength is substantially equal to the dielectric strength of the insulating material used on the coils 12, typically epoxy, is also preferred. The matching of the dielectric strengths reduces the dielectric stress on the interface between the coil 12 and the duct 13. Reducing the dielectric stress will extend the life of the transformer by reducing its harmful effects. Additional ducts 13 and sleeves 14 can be incorporated dependent upon the amount of cooling desired. If several circulatory paths are desired, the ducts 13 and manifolds 24, 26 can be tied together to one or more sleeves 14 as shown in FIG. 5, or two larger manifolds 24, 26 can be used to cover the top and bottom of the coil 12, such as disclosed in FIG. 6.

While the specific embodiments have been illustrated and described, numerous modifications come to mind without significantly departing from the spirit of the invention and the scope of protection is only limited by the scope of the accompanying claims.

I claim:

1. A method of cooling a transformer, comprising the steps of:

forming a winding defining a coil, the winding insulated with a resin having a dielectric strength and the coil including a duct having an open top and an open bottom;

providing a sleeve having an upper manifold and a lower manifold;

forming a closed circulatory path between the sleeve and the duct;

sealing the upper manifold to the top of the coil and the lower manifold to the bottom of the coil;

providing a fluid having a dielectric strength substantially equal to the dielectric strength of the resin; and, retaining the fluid within the circulatory path.

2. The method of claim 1 wherein the transformer is of the type hybrid epoxy cast resin.

3. The method of claim 1 wherein the duct is generally longitudinal.

4. The method of claim 1 wherein the circulatory path comprises a heat exchanger.

5. The method of claim 1 wherein the fluid is a liquid selected from the group consisting of oil, silicone and mineral oil.

6. A method of cooling an epoxy cast resin transformer, comprising the steps of:

forming a primary winding and a secondary winding defining a coil, the coil including a duct having an open top and an open bottom;

providing a sleeve having an upper manifold and a lower manifold;

forming a closed circulatory path between the sleeve and the duct;

sealing the upper manifold to the top of coil and the lower manifold to the bottom of the coil;

providing a fluid having a dielectric strength substantially equal to the dielectric strength of the epoxy; and, retaining the fluid within the circulatory path.

7. The method of claim 6 wherein the transformer is of the type hybrid epoxy cast resin.

8. The method of claim 6 wherein the duct is generally longitudinal.

9. The method of claim 6 wherein the circulatory path comprises a heat exchanger.

10. The method of claim 6 wherein the fluid is a liquid selected from the group consisting of oil, silicone and mineral oil.

11. A method of cooling an epoxy cast resin transformer, comprising the steps of:

forming a primary winding and a secondary winding defining a coil, the primary and secondary winding defining a duct having an open top and an open bottom;

providing a sleeve having an upper manifold and a lower manifold;

forming a closed circulatory path between the sleeve and the duct;

sealing the upper manifold to the top of coil and the lower manifold to the bottom of the coil;

providing a fluid having a dielectric strength substantially equal to the dielectric strength of the epoxy; and, retaining the fluid within the circulatory path.

12. The method of claim 11 wherein the transformer is of the type hybrid epoxy cast resin.

13. The method of claim 11 wherein the duct is generally longitudinal.

14. The method of claim 11 wherein the circulatory path comprises a heat exchanger.

15. The method of claim 11 wherein the fluid is a liquid selected from the group consisting of oil, silicone and mineral oil.

16. A cooling system for an epoxy cast resin transformer, comprising:

a winding defining a coil;

the coil including a duct having an open top and an open bottom;

a sleeve having an upper manifold and a lower manifold;

the upper manifold sealed to the top of the coil and the lower manifold sealed to the bottom of the coil, defining a closed circulatory path; and, a fluid having a dielectric strength substantially equal to the dielectric strength of the epoxy retained within the closed circulatory path.

17. The system of claim 16 wherein the transformer is of the type hybrid epoxy cast resin.

18. The system of claim 16 wherein the duct is generally longitudinal.

19. The system of claim 16 wherein the sleeve comprises a heat exchanger.

20. The system of claim 16 wherein the fluid is a liquid selected from the group consisting of oil, silicone and mineral oil.

21. A cooling system for an epoxy cast resin transformer, comprising:

a primary winding;

a secondary winding;

the primary winding and secondary winding defining a coil;

the coil including a duct having an open top and an open bottom;

a sleeve having an upper manifold and a lower manifold;

the upper manifold sealed to the top of the coil and the lower manifold sealed to the bottom of the coil, defining a closed circulatory path; and, a fluid having a dielectric strength substantially equal to the dielectric strength of the epoxy retained within the closed circulatory path.

22. The system of claim 21 wherein the transformer is of the type hybrid epoxy cast resin.

23. The system of claim 21 wherein the duct is generally longitudinal.

24. The system of claim 21 wherein the sleeve comprises a heat exchanger.

25. The system of claim 21 wherein the fluid is a liquid selected from the group consisting of oil, silicone and mineral oil.

26. A cooling system for an epoxy cast resin transformer, comprising:

a primary winding;

a secondary winding;

the primary winding and secondary winding defining a coil;

the primary winding and secondary winding defining a duct having an open top and an open bottom;

a sleeve having an upper manifold and a lower manifold;

the upper manifold sealed to the top of the coil and the lower manifold sealed to the bottom of the coil, defining a closed circulatory path; and, a fluid having a dielectric strength substantially equal to the dielectric strength of the epoxy retained within the closed circulatory path.

27. The system of claim 26 wherein the transformer is of the type hybrid epoxy cast resin.

28. The system of claim 26 wherein the duct is generally longitudinal.

29. The system of claim 26 wherein the sleeve comprises a heat exchanger.

30. The system of claim 26 wherein the fluid is a liquid selected from the group consisting of oil, silicone and mineral oil.

* * * * *